United States Patent [19]

Tanaka et al.

[11] Patent Number: 4,970,812

[45] Date of Patent: Nov. 20, 1990

[54] SHEET TYPE LARGE DISPLAY UNIT

[75] Inventors: Issei Tanaka, Yokohama; Akio Uchida; Tadashi Irie, both of Tokyo, Japan

[73] Assignee: Stanley Electric Co., Ltd., Tokyo, Japan

[21] Appl. No.: 421,638

[22] Filed: Oct. 16, 1989

Related U.S. Application Data

[63] Continuation-in-part of Ser. No. 268,158, Nov. 7, 1988, abandoned.

[30] Foreign Application Priority Data

Aug. 7, 1987 [JP] Japan ..... 62-121315

[51] Int. Cl.[5] ..... G09F 9/00

[52] U.S. Cl. ..... 40/452; 40/444; 40/550; 40/581; 40/624

[58] Field of Search ..... 40/452, 550, 552, 541, 40/584, 442, 444, 581, 624; 340/782, 815.03; 362/267, 800

[56] References Cited

U.S. PATENT DOCUMENTS

| | | | |
|---|---|---|---|
| 3,163,949 | 1/1965 | Gley | 40/452 |
| 4,254,453 | 3/1981 | Mouyard et al. | 40/550 |
| 4,612,720 | 9/1986 | Manners-Smith et al. | 40/451 |
| 4,727,289 | 2/1988 | Uchida | 362/800 |
| 4,742,432 | 5/1988 | Thillays et al. | 362/800 |
| 4,783,920 | 11/1988 | Tolk | 40/550 |
| 4,851,824 | 7/1989 | Murata | 340/782 |

FOREIGN PATENT DOCUMENTS

| | | | |
|---|---|---|---|
| 2520247 | 11/1976 | Fed. Rep. of Germany | 40/541 |
| 2363846 | 3/1978 | France | 40/444 |
| 2551242 | 3/1985 | France | 340/782 |
| 61-198982 | 12/1986 | Japan . | |
| 62-18916 | 4/1987 | Japan . | |
| 2139340A | 11/1984 | United Kingdom | 362/800 |
| 2180383A | 3/1987 | United Kingdom . | |

*Primary Examiner*—Kenneth J. Dorner
*Assistant Examiner*—Brian K. Green
*Attorney, Agent, or Firm*—Frishauf, Holtz, Goodman & Woodward

[57] ABSTRACT

A sheet type large display unit includes a thin, flexible back sheet which is capable of being rolled up, the flexible back sheet having a plurality of electrical connections formed thereon in rows and columns; a plurality of display dot devices mounted on the front surface of the back sheet in a matrix arrangement, each display dot device including four light emitting diodes mounted on a printed circuit board substrate and connected with the electrical connections; a thin, flexible transparent display sheet which is capable of being rolled up, the display sheet being in covering relation to the display dot devices; and an adhesive which secures the peripheral edge of the display sheet in sealing relation to the peripheral edge of the back sheet.

15 Claims, 3 Drawing Sheets

SHEET TYPE LARGE DISPLAY UNIT

CROSS-REFERENCE TO RELATED APPLICATION

This Application is a Continuation-In-Part of U.S. patent application Ser. No. 07/268,158, filed Nov. 7, 1988, now abandoned, entitled SHEET TYPE LARGE DISPLAY UNIT, to the same inventors herein.

BACKGROUND OF THE INVENTION

This invention relates generally to display units, and more particularly, to a large display unit which is used outdoors for advertisements, announcements, or the like.

A conventional large display unit for outdoor use is known which includes a display panel made of a hard metal or resin and formed with display windows arranged in, for example, a 24×24 matrix. A printed circuit board is mounted on the back of the display panel and includes a plurality of light emitting diodes (LEDs) mounted thereon in correspondence with the display windows. A driver circuit board is mounted behind the printed circuit board. The driver circuit board receives a character code from an external circuit and converts it into drive signals which are supplied to the light emitting diodes. As a result, only certain ones of the light emitting diodes are illuminated. Each display unit is adapted to display a single character. Accordingly, a plurality of display units are arranged in order to display a message, with each display unit displaying a single character.

Since each display unit is primarily intended to be used outdoors, it is housed within a waterproof casing having a waterproof electrical connector for receiving the character code from the aforementioned external circuit. Since the display windows ar covered with glass or the like so as to seal the windows from the external environment, the entire structure of the display unit and casing is made waterproof.

However, such conventional display unit is disadvantageous for various reasons.

First, the weight and volume of each display unit is large so that transportation and maintenance of the display unit becomes difficult.

Secondly, because of the large weight of the display unit, a large frame is required to mount the display unit, resulting in a semi-permanent installation. In other words, such display units are not suitable for temporary use such as in entertainment applications, or at parties, meetings, or the like. Also, because of the large frame, transportation is difficult.

Third, because of the semi-permanent installation, measures to cope with damage from wind and other environmental elements become necessary, resulting in an expensive mounting frame.

Fourth, it will be appreciated that, because of the weight of the display units, and thereby the strong mounting frame that is required, it is impossible to make a display unit larger than approximately 90×90 cm. Since the display units cannot be made of a sufficiently large size, it is difficult to clearly recognize a displayed character from a remote position and to attract viewers when the display unit is used outdoors.

OBJECTS OF THE INVENTION

It is therefore an object of the present invention to provide a large display unit that overcomes the aforementioned problems with the prior art.

It is another object of the present invention to provide a large display unit which is relatively lightweight, is not bulky, has a small volume and is easily and readily portable.

It is still another object of the present invention to provide large display unit that is flexible and can easily be transported in rolled-up form.

It is yet another object of the present invention to provide a large display unit that is relatively easy and economical to manufacture and use.

SUMMARY OF THE INVENTION

In accordance with an aspect of the present invention, a large display unit includes a thin, flexible back sheet which is capable of being rolled up, the flexible back sheet including a first surface having a peripheral edge and a plurality of electrical connections formed on the first surface; a plurality of display dot devices mounted on the first surface of the flexible back sheet in a matrix arrangement, each display dot device including at least one light emitting element connected with the electrical connections; and a thin, flexible display sheet which is capable of being rolled up, the flexible display sheet having a peripheral edge secured in sealing relation to the peripheral edge of the flexible back sheet and in covering relation to the display dot devices, the flexible display sheet being at least translucent.

DETAILED DESCRIPTION

Figure 1:
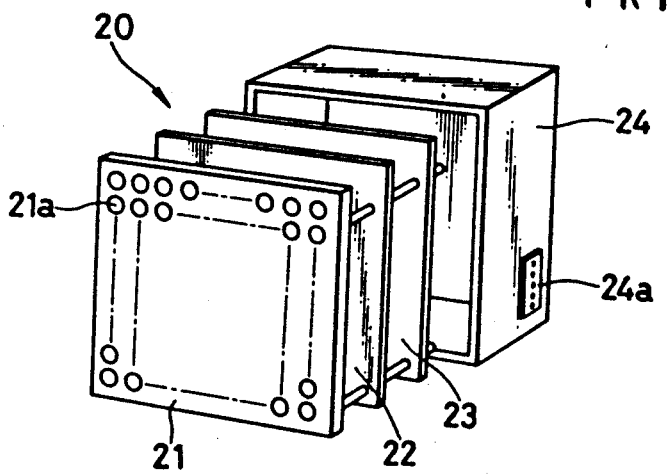
FIG. 1 PRIOR ART
FIG. 1 is a perspective exploded view of a conventional display unit.

Referring to the drawings in detail, and initially to FIG. 1 thereof, a conventional display unit 20 according to the prior art includes a display panel 21 made of a hard metal or resin. Display panel 21 is shown in a substantially square configuration, although the present invention is not limited thereby. A plurality of circular display windows 21*a* are formed in display panel in a matrix arrangement, for example, a 24×24 matrix. Each display window 21*a* is covered with glass, plastic, or the like to seal it from the external environment, and in this regard, such glass, plastic or the like is at least translucent, and is preferably transparent.

Display unit 20 further includes a light emitting element holder 22, which is preferably a printed circuit board, mounted on the rear surface of display panel 21. A plurality of light emitting elements (not shown), such as light emitting diodes (LEDs), are mounted on light emitting element holder 22 in the same matrix arrangement as display windows 21*a* and in registry therewith. Accordingly, each display window 21*a* is adapted to display an illuminated dot. A driver circuit board 23 is mounted behind light emitting element holder 22. Driver circuit board 23 receives a character code from an external circuit and converts the character code into suitable drive signals which are supplied to selected ones of the light emitting elements to cause a single character to be displayed by display unit 20 by means of the illuminated dots through display windows 21*a*.

Since display unit 20 is intended to be used primarily outdoors, the aforementioned arrangement of display panel 21, light emitting element holder 22 and driver circuit board 23 are housed within a waterproof casing 24 of display unit 20. Waterproof casing 24 is further provided with a waterproof electrical connector 24*a* which provides a waterproof electrical connection between driver circuit board 23 and an external circuit. Because casing 24 and electrical connector 24*a* are waterproof, and since display windows 21*a* are sealed by glass, plastic or the like, the entire structure of display unit 20 is made waterproof.

However, as previously discussed, display unit 20, because of its rigid structure, has various disadvantages. Specifically, transportation and maintenance of display unit 20 becomes difficult due to the weight and bulkiness thereof. In addition, display unit 20 must be mounted in a large frame because of its weight, resulting in problems in transporting the same and erecting the same for temporary use. Further, because of the semi-permanent installation thereof, additional measures must be provided to cope with damage from wind and other environmental elements. Finally, it is difficult, because of the great weight and need for a strong mounting frame, to provide display unit 20 larger than 90×90 cm. As a result, it becomes difficult to clearly recognize a displayed character from a remote position and to attract viewers when the display unit is used outdoors.

Figure 4:
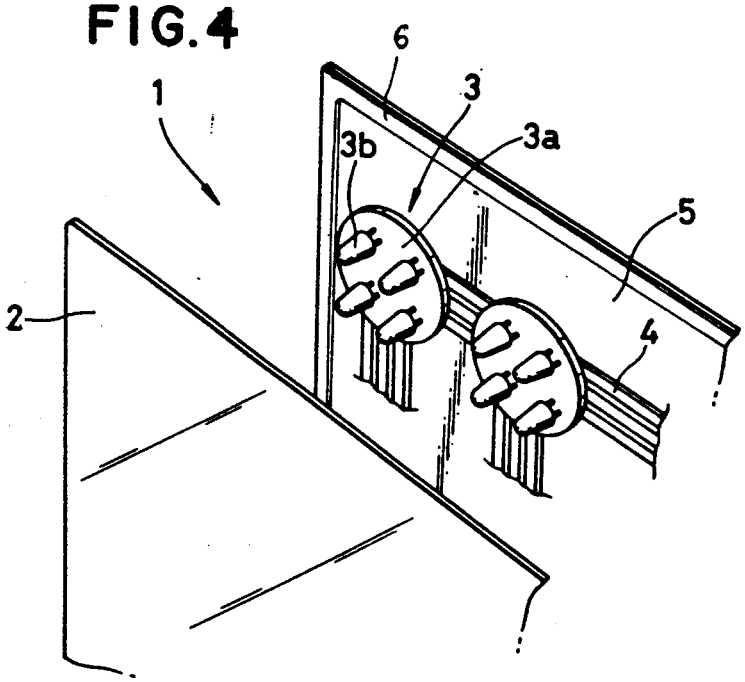
FIG. 4 is a perspective exploded view of a portion of the display unit of FIG. 2.
Figure 2:
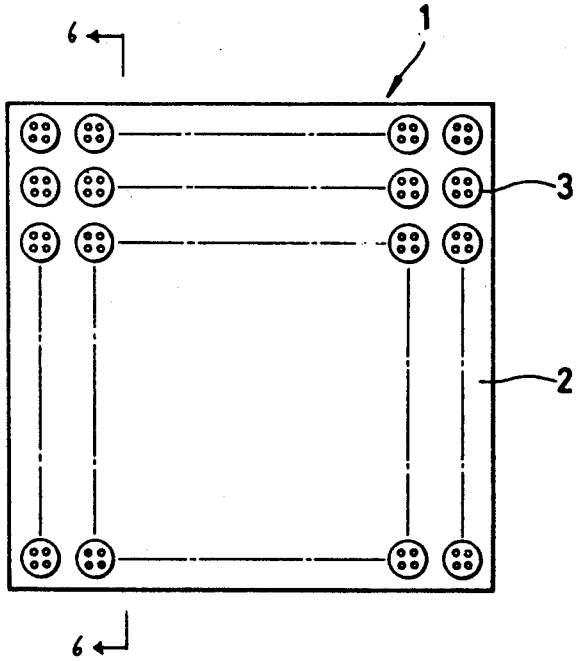
FIG. 2 is a front plan view of a sheet type large display unit according to one embodiment of the present invention.
Figure 3:
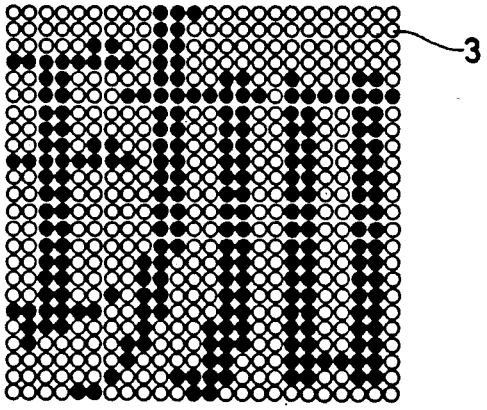
FIG. 3 is a plan view showing a displayed character on the display unit of FIG. 2.

Referring now to FIGS. 2–4, a sheet type large display unit 1 according to one embodiment of the present invention includes a flexible back sheet 5, preferably of a square configuration, although other suitable configurations, such as circular, rectangular or the like can be used. Preferably, back sheet 5 is opaque and can be made, for example, of polyester and cloth coated with vinyl chloride. A plurality of electrical connections 4 are formed in two orthogonal directions, that is, in intersecting rows and columns, on one surface of back sheet 5. In this manner, back sheet 5 with electrical connections 4 effectively forms a flexible printed circuit board.

A plurality of display dot devices 3 are mounted on the surface of flexible back sheet 5 in a matrix arrangement, for example, in an 18×18, a 24×24, or the like dot matrix array. It will be appreciated from the discussion hereinafter, that the matrix array that is utilized will depend upon the character resolution that is desired. Each display dot device 3 is electrically connected at the corners of intersecting electrical connections 4 formed on back sheet 5 so as to be supplied with signals from an external circuit (not shown).

Each display dot device 3 includes at least one light emitting element 3*b*, such as a light emitting diode (LED) mounted on a substrate 3*a*, such as a printed circuit board which is made of a hard or soft material, substrate 3*a* being electrically connected with electrical connections 4. It will therefore be appreciated that, in display unit 1 having a 24×24 dot matrix array, there will be 576 display dot devices 3, each display dot device 3 being connected by electrical connections 4 to an external driver circuit which drives the respective display dot device 3 with a specific driving method such as a dynamic, static or other driving method. By selectively turning on different display dot devices 3, a character such as the Chinese character shown in FIG. 3, can be displayed.

Securement of display dot devices 3 to back sheet 5 may be effected by any suitable means, such as an adhesive, high-frequency welding or the like. In a preferred embodiment of the present invention, each display dot device 3 includes four light emitting elements 3*b*, as shown, each corresponding to a different color, for example, red, yellow, green, and white. Accordingly, by selectively activating light emitting elements 3*b* of different colors, it becomes possible to provide a display having different colors.

It is an important aspect of the present invention that back sheet 5 with electrical connections 4 and display dot devices 3 thereon, be sufficiently flexible so that it can be folded or rolled up, such as a rolled carpet, when not in use.

Figure 5:
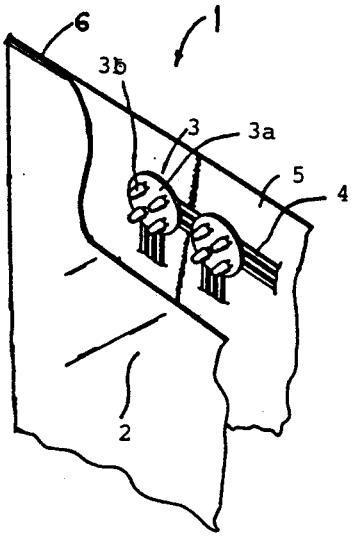
FIG. 5 is a perspective view, partially broken away, of a portion of the display unit of FIG. 2.
Figure 6:
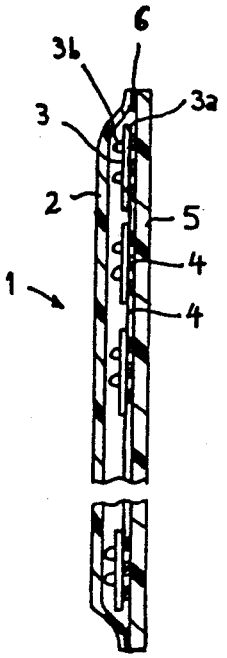
FIG. 6 is a cross-sectional view of the display unit of FIG. 2, taken along line 6—6 thereof.

A flexible display sheet 2 is secured to back sheet 5 in covering relation to display dot devices 3. In this regard, display sheet 2 has the same flexibility as back sheet 5 so that it ca be rolled up. Display sheet 2 is preferably of the same dimensions and shape as back sheet 5 and is secured thereto at the peripheral edge thereof. As shown best in FIGS. 4–6, an adhesive 6 is provided on the front surface of back sheet 5 along the peripheral edge thereof so that the peripheral edges of flexible display sheet 2 and flexible back sheet 5 are secured together in a water-tight sealing relation. As a result, display dot devices 3 are protected from the environment. As an example, adhesive 6 can be formed of, for example, a polyester based and vinyl chloride based adhesive, a polyester based and acrylic based adhesive, or a polyester based and epoxy based adhesive.

It will be appreciated that flexible display sheet 2 is at least translucent, and is preferably transparent. It is preferable that display sheet 2 is made of a transparent sheet of vinyl chloride or resin.

Since display unit 1 is comprised of display sheet 2 and back sheet 5 which are both made of a flexible material, the entire structure of display unit 1 is flexible. As a result, display unit 1 can be rolled up, for example, like a carpet, folded or the like for storage and shipping. In addition, since display sheet 2 and back sheet 5 are flexible, they are made of a thin, lightweight material, which further reduces the cost of manufacture and shipping. It will be appreciated that display unit 1 is also water-proof because of the securement of the peripheral edges of display sheet 2 and back sheet 5 by adhesive 6. A water-proof connector (not shown) and water-proof drive circuit (not shown) may be provided on display unit 1, as is conventional. Further, because display unit 1 is relatively thin and lightweight, it can merely be hung from a wall, and no large frames are required for holding the same.

Therefore, display unit 1 according to the present invention provides distinct advantages over conventional display units.

Specifically, because of the relatively lightweight and flexible nature of display unit 1, it can be folded or rolled up so that transportation and maintenance thereof becomes very easy.

Second, because display unit 1 is lightweight, it can be easily and properly installed, for example, by hanging the same from a wall, structure, or the like. Therefore, temporary installation for parties, meetings, or the like becomes easy, and dismounting of display unit 1 can be readily performed in an emergency such as a typhoon or the like.

Third, display unit 1 is relatively inexpensive to manufacture and use, and it is easily transportable.

Finally, display unit 1 can be made of a relatively large size, which allows easy recognition of characters from a remote position, thus attracting a viewer.

Figure 7:
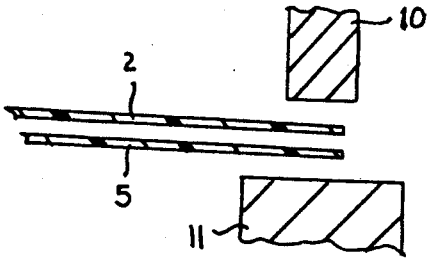
FIG. 7 is an elevational view showing assembly of the display unit of FIG. 2 according to another embodiment of the present invention.

It will be appreciated that various modifications can be made to the present invention. For example, although it has been described that the peripheral edges of display sheet 2 and back sheet 5 are secured together by an adhesive 6, any other suitable means for securing these sheets together can be provided. For example, adhesion by heat can be provided, as shown in FIG. 7. In such case, a heating element 10 is provided in conjunction with a base 11 for heating, thereby securing the peripheral edges of display sheet 2 and back sheet 5 together, as shown in FIG. 7.

Having described specific preferred embodiments of the invention with reference to the accompanying drawings, it will be appreciated that the present invention is not limited to those precise embodiments, and that various changes and modifications can be effected therein by one of ordinary skill in the art, without departing from the spirit or scope of the invention as defined by the appended claims.

What is claimed is:

1. A large sheet type display unit, comprising:

a back sheet of relatively thin flexible sheet material capable of being easily deformed by hand into a rolled up configuration, said back sheet including a first surface having a peripheral edge, and a plurality of electrical connections formed on said first surface for connecting to an external display drive circuit;

a plurality of display dot devices mounted on the first surface of said back sheet in a matrix arrangement, each display dot device including at least one light emitting element connected with said electrical connections; and a display sheet of relatively thin, flexible and at least partially transparent sheet material capable of being easily deformed by hand into a rolled up configuration, said display sheet having a peripheral edge secured in sealing relation to the peripheral edge of the back sheet and in environmentally protective covering relation to said display dot devices;

wherein said back sheet and said display sheet when sealed to one another can be readily reformed by hand between a flat operating display position, and a storage position in which both of the sheets as sealed to one another are folded or rolled up for storage and shipping.

2. The sheet type unit according to claim 1, wherein said back sheet is opaque.

3. The sheet type display unit according to claim 2, wherein said back sheet is formed from a sheet of polyester and cloth coated with vinyl chloride.

4. The sheet type display unit according to claim 1, wherein said back sheet has a substantially square configuration.

5. The sheet type display unit according to claim 1, wherein each display dot device includes a printed circuit board and a plurality of light emitting elements on said board.

6. The sheet type display unit according to claim 5, wherein each light emitting element of a respective said display dot device emits light of a color different from at least one other light emitting element of said respective display dot device.

7. The sheet type display unit according to claim 6, wherein each light emitting element of a respective display dot device emits light of a different color from each other light emitting element of the respective display dot device.

8. The sheet type display unit according to claim 7, wherein each light emitting element includes a light emitting diode.

9. The sheet type large display unit according to claim 1, wherein each light emitting element includes a light emitting diode.

10. The sheet type display unit according to claim 1, wherein each display dot device includes four light emitting elements.

11. The sheet type display unit according to claim 1, wherein said display sheet is transparent.

12. The sheet type display unit according to claim 1, wherein said display sheet is made from a transparent sheet of vinyl chloride.

13. The sheet type display unit according to claim 1, wherein said display sheet is secured in sealing relation to the back sheet by a heat seal.

14. The sheet type display unit according to claim 1, further including adhesive means for securing the peripheral edge of the display sheet in sealing relation to the peripheral edge of the back sheet.

15. The sheet type display unit according to claim 14, wherein said adhesive means is selected from the group consisting of (a) a polyester based and vinyl chloride based adhesive, (b) a polyester based and acrylic based adhesive, and (c) a polyester based and epoxy based adhesive.

* * * * *